US006898954B2

(12) United States Patent
Twigg et al.

(10) Patent No.: US 6,898,954 B2
(45) Date of Patent: May 31, 2005

(54) APPARATUS AND METHOD FOR DIE INERTING

(75) Inventors: Richard Twigg, Muskogee, OK (US); Robert Oesterreich, Sugarland, TX (US)

(73) Assignee: Air Liquide American, L.P., Houston, TX (US)

( * ) Notice: Subject to any disclaimer, the term of this patent is extended or adjusted under 35 U.S.C. 154(b) by 16 days.

(21) Appl. No.: 10/306,322

(22) Filed: Nov. 27, 2002

(65) Prior Publication Data

US 2004/0099030 A1 May 27, 2004

(51) Int. Cl.[7] ..... B21B 9/00

(52) U.S. Cl. ..... 72/38; 72/17.3; 72/257; 72/271

(58) Field of Search ..... 72/14.8, 16.1, 72/17.3, 38, 253.1, 257, 271, 273.5

(56) References Cited

U.S. PATENT DOCUMENTS 3,808,865 A * 5/1974 Wagner et al. ..... 72/269
3,874,207 A * 4/1975 Lemelson ..... 72/56
4,316,373 A * 2/1982 Zilges et al. ..... 72/45
4,379,398 A * 4/1983 Asari et al. ..... 72/273.5
4,578,973 A 4/1986 Ishimaru et al.
4,727,747 A * 3/1988 Naud et al. ..... 72/38
5,133,126 A 7/1992 Matsuoka
5,167,138 A * 12/1992 Sinha et al. ..... 72/262
5,782,120 A * 7/1998 Wright ..... 72/38
5,894,751 A 4/1999 Bourgoine et al.

* cited by examiner

*Primary Examiner*—Ed Tolan
(74) *Attorney, Agent, or Firm*—Linda K. Russell

(57) ABSTRACT

An improved apparatus and method for metal extrusion applications and presses wherein high purity inert and/or partially inert gases are introduced at or near the die exit. The environment at or near the exit is also preferably analyzed and/or monitored on a continual or nearly continual basis. The environment is also preferably controlled to which minimize or eliminate oxidation of metals and other extruded materials. The apparatus and method allow faster extrusion rates, improved surface quality of the extruded materials, and increased die life. In an embodiment, bi-phasic inerting media may also be used.

64 Claims, 5 Drawing Sheets

APPARATUS AND METHOD FOR DIE INERTING

FIELD OF INVENTION

This invention relates to an apparatus and method for improved extrusion applications. The improved extrusion process includes the feature of analyzing the environment or atmosphere and controlling the environment at or near the die exit.

DESCRIPTION OF THE RELATED ART

In the process of extruding metals, metal alloys, and other oxidizing materials, it is known that the presence of oxygen causes an oxide layer to form in and around the die, backer, bolster, die exit, tunnel or platen, as well as the extruded product.

U.S. Pat. No. 5,894,751 is directed to a shroud canister for reducing the oxidation of extruded metal in an extrusion press by introducing an inert substance in liquid form into a die ring. In an embodiment the shroud canister consists of a face plate which is attached to the platen of the extrusion press, a fluid supply tube for injecting the inert substance into the bore of the platen, and a shield to preclude any of the substance which is in liquid form from leaving the supply tube and coming into contact with the extruded material. Another embodiment consists of a cylindrical canister with one or more apertures for the extruded metal and a relatively inert substance supply cavity that communicates with the supply to inject the substance into the product apertures. Kevlar strips may also be hung across the faceplate in order to cover the aperture in the faceplate to further retard the introduction of oxygen into the bore of the platen.

U.S. Pat. No. 3,808,865 is directed to a method and apparatus for extrusion of work pieces. The invention uses a cooling medium to transfer excessive heat from the apparatus, in order to increase extrusion speed. Therein, a deep cold liquefied inert gas is used the cooling medium to create a protective atmosphere at the downstream end of the apparatus to eliminate the oxidizing effects of normal air.

U.S. Pat. No. 4,578,973 is directed to a process for producing hollow aluminum extrudates for use in a high vacuum environment. The disclosed process concerns producing a hollow aluminum extrudate for use in a vacuum which comprises the steps of hermetically closing the forward open end of a hollow shaped material immediately after extrusion, cutting the material after a pre-determined length, and hermetically closing the cut end during extrusion so the inner surface of the hollow portion is out of contact with the atmosphere to thereby inhibit an oxide layer from forming. The process is also operated in a high vacuum environment. Therein, the mixture comprises approximately 0.5 to 30% by volume of oxygen, with the balance being an inert gas.

U.S. Pat. No. 5,133,126 is further directed to a method of producing aluminum tube covered with zinc. Therein, the method of producing an aluminum tube that is covered by a layer of zinc is disclosed. Herein, the oxidation problem is solved with using flame sprayed zinc powder the method comprises the steps of providing a cold forming machine with an extrusion die assembly aluminum prime wire and extruding the wire while heating the die to about 450° to 550° C., blowing an inert gas across the die thereby providing a non-oxidized aluminum tube, then flame spraying zinc powder onto the outer non-oxidized surface of the tube thereby covering the surface an providing an anti-corrosive layer.

DESCRIPTION OF THE PREFERRED EMBODIMENTS

Figure 1:
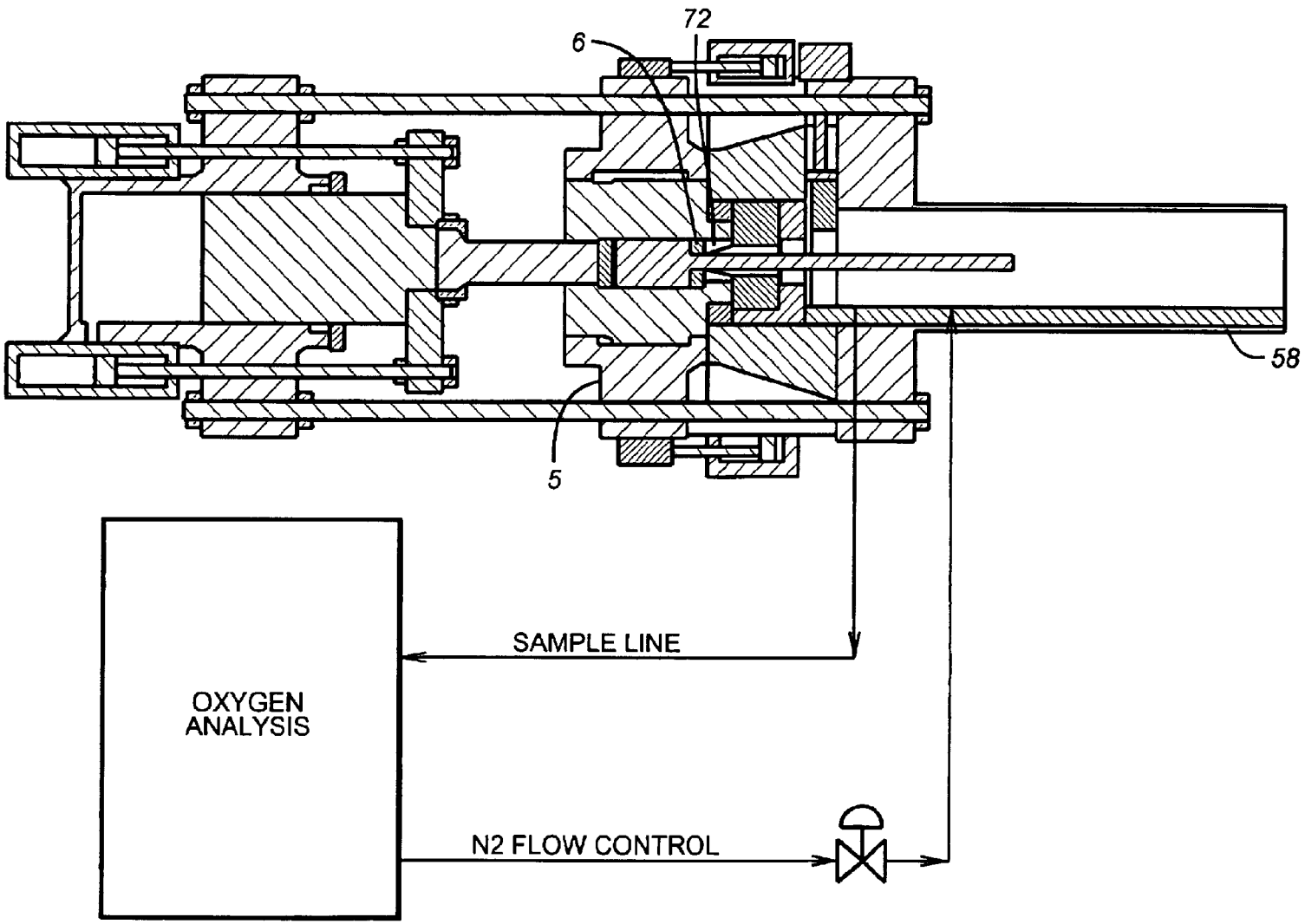
FIG. 1 shows an embodiment of an apparatus of the invention.

For purposes of the description of this invention, the terms "up," "down," "near," "bottom," and other related terms shall be defined as to relation of embodiments of the present invention as it is shown and illustrated in the accompanying figures. However, it is to be understood that the invention may assume various alternative structures and processes and still be within the scope and meaning of this disclosure. Further, it is to be understood that any specific dimensions and/or physical characteristics related to the embodiments disclosed herein are capable of modification and alteration while still remaining within the scope of the present invention and are, therefore, not intended to be limiting.

The properties and the surface of extruded materials and work pieces that are formed out of aluminum, metal, metal alloys, and especially metals which oxidize during the extrusion process are determined by a variety of factors, especially the billet or ingot temperature and the speed of extrusion. If a higher temperature is used during the extrusion process, there is less deformation work required by the press. However due to heat buildup, the aluminum or other metal almost becomes liquid, which typically causes the metal to oxidize. During typical operations where atmospheric oxygen may be present in relatively large concentrations, oxides collect at the downstream end of the working surface of the material or tool like a crust, and the formation of these deposits are promoted with deformation heat in the working parts of the die exit area and/or extruded material.

The invention utilizes high purity nitrogen or argon, in gaseous and/or in a bi-phasic form, i.e., gas and liquid, to purge the environment or atmosphere at or near the exit side of the die, and if applicable, also through the platen 18 or platen tunnel 58. Oxides, which normally appear on the surface of the extrudate, as well as the working parts of the die exit area are the main sources of surface imperfections and defects such as hot tears, die lines, and pinning, and other types of disintegration of the oxide layer that cannot be tolerated on products or extrudates which require smooth, ornate finishes. These oxide deposits also create local hot spots due to the friction between the abrasive oxide and the extrudate, and are extremely wear resistant. If unregulated and unmonitored oxide layer collects behind the die bearing and causes die pickup, during the prior art methods, using the prior art apparatuses. However, by inerting preferably all the critical areas of the extrusion press, e.g., tools or devices for storing, cutting or shaping, the die 5, backer 13, bolster 17, and flat metal plate, oxides are nearly or completely eliminated. See e.g. FIGS. 1–3. In fact an inerting atmosphere can be used to minimize the oxidation reaction or even eliminate the oxidation reaction and the undesirable oxide deposits.

When inert or partially inert gases are injected or otherwise introduced into the die area of an extrusion press or environment at or near the die exit, the inerting gas displaces the atmospheric air thereby significantly reducing the formation of oxides, since less oxygen is available. By inerting the die exit and platen zones, the deposit reaction: $Al+O_2=Al_2O_3$ is controlled by minimizing oxygen which therefore limits the oxide production and reduces deposits. This design and process supplies an oxygen-depleted atmosphere at or near the die exit. Moreover, the use of high purity nitrogen or inerting gas improves productivity with an extrusion rate increase of up to or about 30%, the extruded metal or part has enhanced shaped integrity and an improved surface finish which appears bright and/or anodized, and also optimally requires less polishing and buffing. The inerting also ensures better surface shape integrity. The use of such inerting gases and/or bi-phasic mixtures has the added benefit of increasing the die run life about twofold, and the traditional post extrusion die cleaning is reduced or eliminated.

Alternatively, liquid and gas, a bi-phasic mixture, can be used with the liquid which depending on amount, may also offer some cooling properties. Moreover, the use of a bi-phasic or liquid-gas mixtures may be used to "purge" the exit area using the rapid expansion going from a liquid to a gas, due to the volume expansion of about a 700–800 fold. Because the die exit area is hot, some liquid is readily vaporized to gas. If the liquid does not all vaporize this can also lead to some undesired irregularities in the extruded materials and pieces.

In the preferred embodiment and process, nitrogen comprises the majority of the inerting gas or media since it is less expensive than helium and argon in applications using only gas, insulated lines and liquid. For simplicity sake such gases will be referred to as inerting gases, or inerting media if it is in a bi-phasic form. Preferably pure nitrogen is used for optimal results. However, the nitrogen used need not be pure, as long as it contains a low concentration of oxygen, such as 1–3% or less, thus preferably resulting in an atmosphere near the die exit of about less than 2%, and optimally about 1% or less. By using nitrogen, preferably containing about or less than 1% oxygen, the production of inferior or off-specification extrusions are eliminated. The invention also contemplates the use of multiple sources of the gas or inerting media with different flow rates, purity, pressure, and/or location near the exit, and the tunnel subcoolers of the prior art are also not necessary.

When choosing and using gaseous and/or liquid nitrogen or other inert or partially inert components during extrusion, especially for aluminum extrusion, several factors need to be considered, such as the maximum oxygen which can be tolerated while still achieving the desired surface quality. Inert gas requirements also vary depending on the alloy, shape, extrusion speeds, and gas flow rate and vary with the number and size of the presses and the number of billets, which are used. Therefore, it is also preferable to include an analyzer to monitor the oxygen content near the die exit. It is also preferable to use a controller, which can regulate the flow, pressure, and in some cases, the purity of the inerting gas used. The monitoring of the environment at or near the die exit coupled with the control of gas flow optimizes the use of such inert gas or inert media.

The extrudate, or if applicable work pieces, can be produced a variety of ways and by using a variety of dies known to one skilled in the art. There are solid, semi hollow, and hollow dies, and the shape of the die determines the shape of the extruded material or part. The extrusion dies may take on various forms, and may have a variety of features that are known to one skilled in the art.

Figure 2:
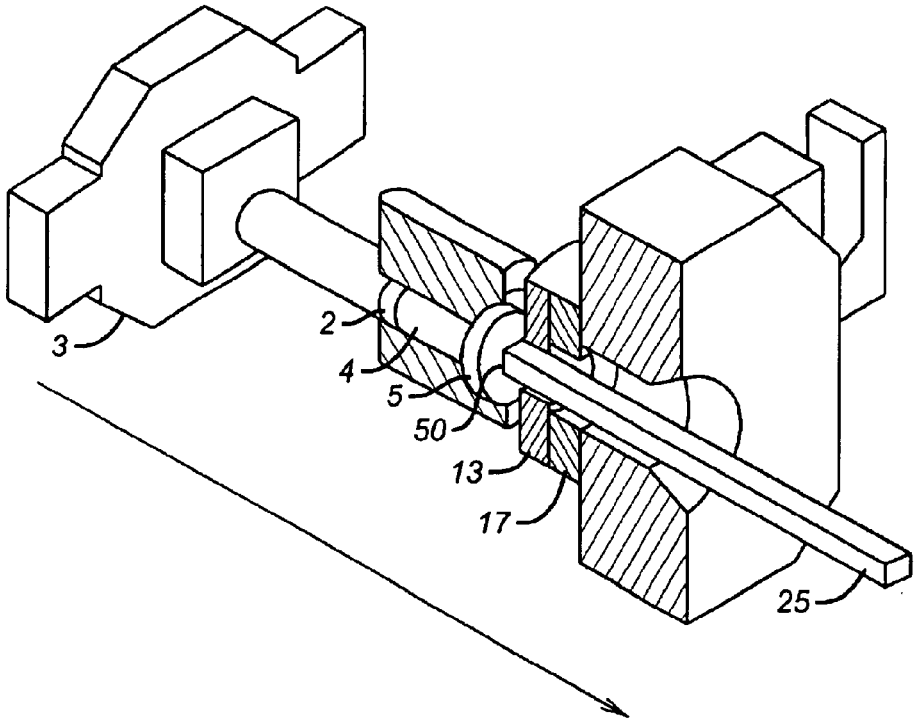
FIG. 2 is a schematic showing an embodiment of the apparatus and method.
Figure 3:
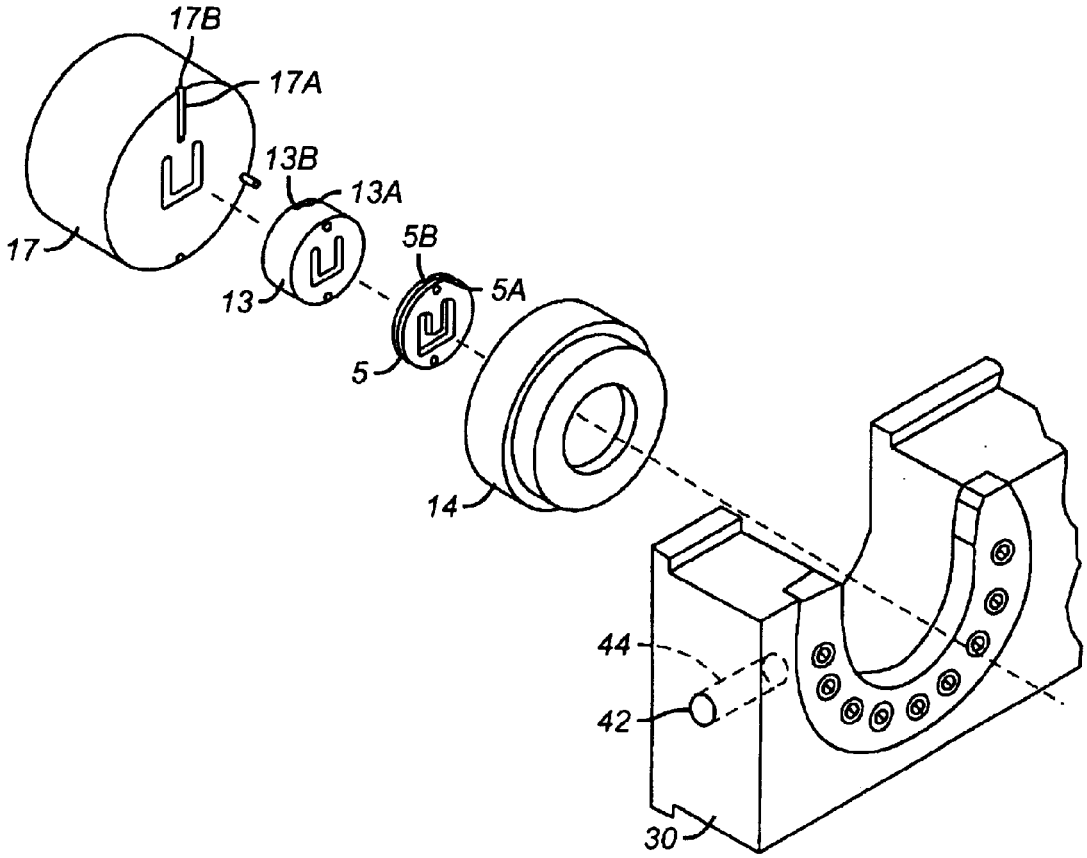
FIG. 3 is a schematic showing an aspect of the invention.

Typically before extrusion, the dies are cleaned with a caustic agent, and a billet 4 of metal or metal alloy is processed at the preferred temperature and time. The aluminum or other metal is heated usually either electrically through induction heaters or through the use of gas fired furnaces. While the temperature and speed of extrusion varies upon the application and metal used, the preferable temperature of the extrusion die is maintained within a range of 450° C. to 550° C. for aluminum applications. Once the metal has reached the desired or specified temperature, it is loaded into the container 1 of the extrusion press 6, an example of which is shown in FIGS. 1, 3 and a perspective cut-away view is shown in FIG. 2. The container 1 of the example press is a hollow chamber that is typically constructed of steel and is usually fitted with a liner 9 that is removable, e.g. see FIG. 3. The container 1 also has an inside diameter slightly larger than the billet 4 which is to be extruded, and holds and confines the billet 4 during the extrusion cycle.

Further down, there is a ram 3, stem 26, a dummy block 2, and a billet 4, a die 5, a die holder or die ring 14, and a bolster 17. See e.g., FIGS. 1–3. There may also be a backer 13 which backs up against the exit or die opening. See e.g., FIGS. 2–3. The die ring 14 and the backer 13 are typically attached to the die 5 to support the die 5 with the die ring 14, and the backer 13 is provided to prevent deformation of the die body 5 due to pressure experienced during the extrusion processes, and there may be a pressure ring 28 adjacent to the die slide 30. See FIG. 7.

The die 5 is a disk typically comprised of steel, and aluminum or other metal is forced through the opening(s) in the die or die exit 50 to create the extruded product. The pressure in an extrusion press 6 is applied by a hydraulic ram 3, which can use exert from about 100 tons to 15,000 tons or more of force. The amount of force which an extrusion press is able to exert determines the profiles that it is capable of producing. After the temperature of the die 5 is adjusted to a desired temperature by a heating device, for example a heater (not shown) mounted between the die 5 and the die ring 14, the metal or metal alloy material is extruded by the hydraulic ram 3 which applies pressure which crushes the billet 4 up against the die, forcing it into contact with the container wall. Once the heated metal is contacted, the pressure increases and the heated metal is pushed through the die opening or exit 50 and emerges at the exit as a shaped profile, e.g., 25.

Figure 4:
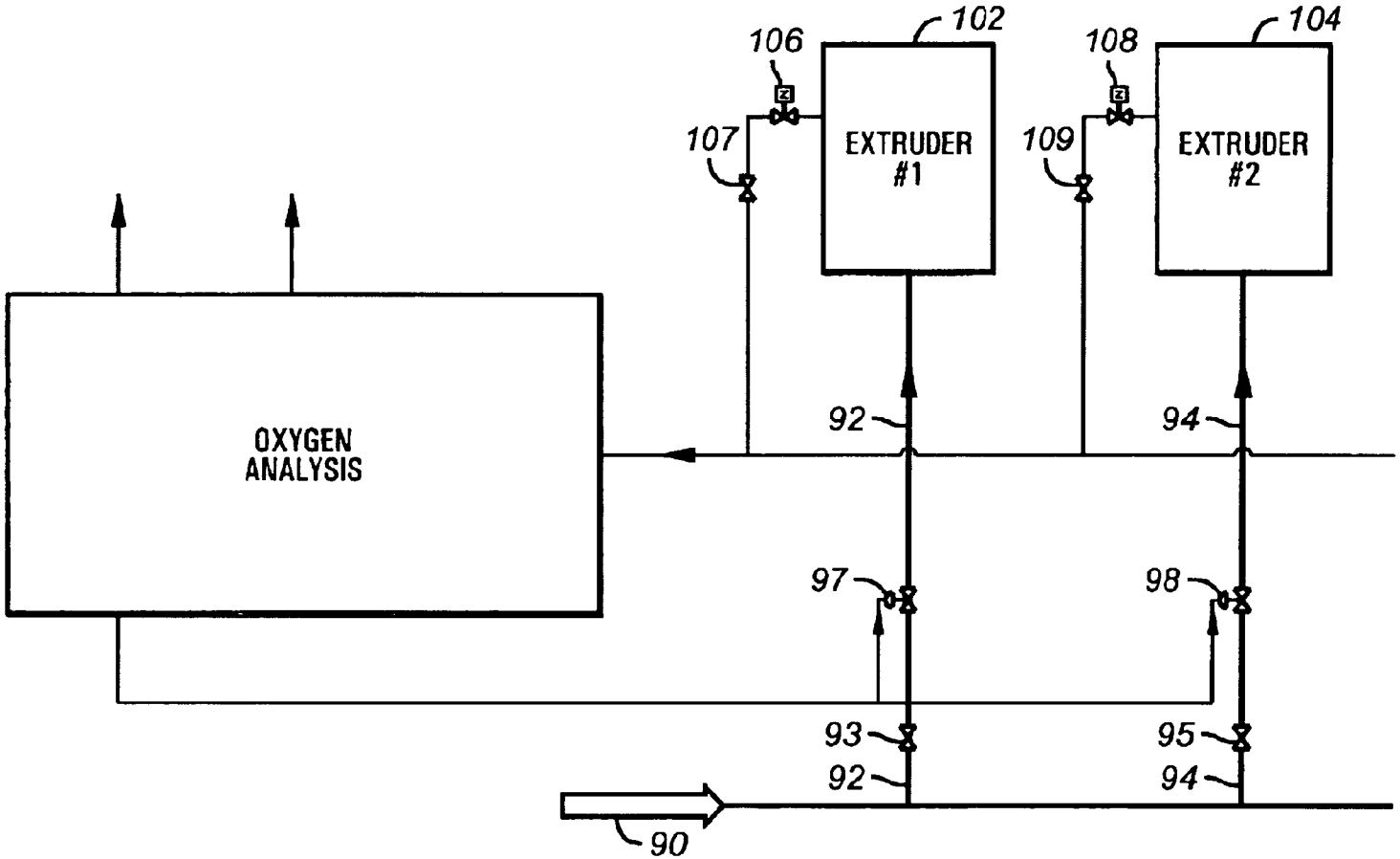
FIG. 4 is an embodiment of the apparatus and method.
Figure 5:
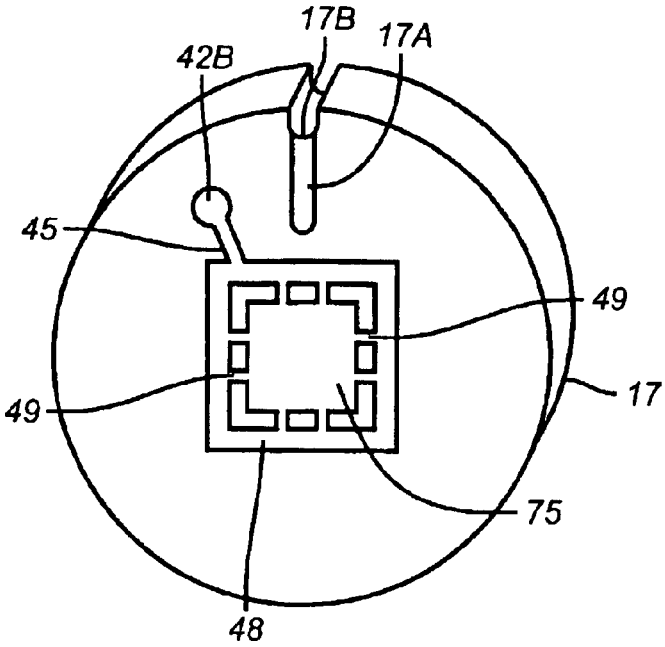
FIG. 5 is a component of the apparatus of the invention.
Figure 6:
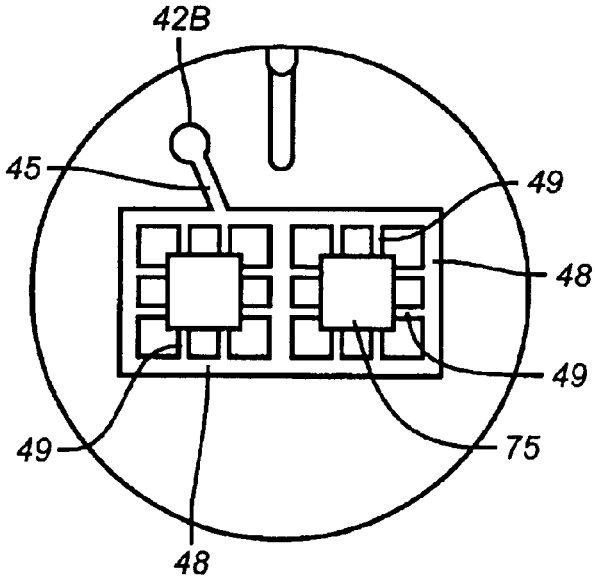
FIG. 6 is a component of the apparatus of the invention.

The apparatus will also further comprise a supply 90, see e.g. FIG. 4, of inert or partially inert gas and/or bi-phasic inerting media that is connected to, near, or at the die exit, typically by lines, and the gas or inerting media may be stored in a standard bulk installation tank with a vaporizer or heat exchanger, or, a portable tank and vaporizer may be used. Also any other manner of obtaining gas suitable for use that is known to one skilled in the art may be used.

Extrusion presses operate in cycles, with a cycle defined as one thrust of the hydraulic ram 3. Depending upon the alloy, the shape may be extruded at a rate of more than 200 feet per minute, and a continuous extrusion about as long as 300 feet may even be produced with each stroke or cycle of the press. The length of time it takes a press to go through one cycle is related to the alloy, billet size, the number of openings or holes in the die, and the shape of the extrusion. As shown in FIG. 3, the die backer 13 is formed with an alignment key 13A, which preferably has an alignment opening 13B. Alternatively or in addition, there may be an alignment key 17A in the bolster 17 which has an alignment opening 17B which assists in keeping the bolster aligned with the backer. Further there may be at least one an alignment key 5A in the die 5 with an alignment opening 5B to keep the die and the backer aligned.

Before and during the extrusion process, the nitrogen or other inerting media is injected until the atmosphere is depleted of oxygen. There may be a single injection or introduction point or port depending upon the type of metal used, size of die, and speed of operation. The free end of a supply line e.g. 92, 94 in FIG. 4 attaches to a gas container or bulk supply, e.g., 90 and is further connected to the extruder and/or the involved conduit 70, e.g. of the backer 13 or die slide 30. See e.g. FIGS. 3 and 7. Preferably, the supply line 65 for the gas or inerting media is made of stainless steel that is flexible, but could also be made of suitable non-corrosive material that is sufficiently durable. See e.g. FIG. 7. The supply line is preferably about ½ inch to 1 inch in diameter or of another diameter that provides a sufficient gas flow and is connected to the inlet 42A, typically by fittings or other such means that allow removable connection of lines. Preferably, at least one port, and preferably only one port is machined in the selected portion of the extruder components such as a bolster 17, backer 13, die 5, die ring 14 or any other suitable location within the extruder in which to introduce the nitrogen or other inerting media. See e.g. FIGS. 3 and 7.

As shown in the embodiments of FIGS. 3, and 5–7, a port 42 is machined into the bolster 17 and has an inlet end 42A and an outlet end 42B, a conduit 70 between the inlet and outlet, with the outlet end 42B joined to a junction 45 that further communicates with a header 48. The header 48 preferably has at least one, and more preferably a plurality of subports 49 that finally lead the inerting gas and/or bi-phasic media to an opening 75 in the bolster 17 or other component. The subports 49 enable a more uniform and intense distribution of the inerting gas or media in the area 72 near or around the die exit, which is a critical area to be inerted. See e.g. FIG. 1. The backer and/or die and/or die ring may also be similarly configured with an inlet end and an outlet end joined by a junction which further communicates with a header (not shown). Again the header of the backer and/or die and/or die ring also preferably has at least one, and more preferably plurality of subports that finally lead the inerting gas to an opening in the backer and/or die and/or die ring (not shown). The incoming gas or inerting media is preferably fed into the bolster and/or backer and/or die and/or die ring through a conduit 70, that may also be machined into the die slide 30. See e.g., FIG. 7. Preferably the free end of a supply line e.g. 65 in e.g., FIG. 7 attaches to a gas container or bulk supply and is further connected at the incoming end 65A to the extruder and/or other involved conduit 70, e.g. of the die slide 30. See e.g. FIG. 7. Also, there is preferably a quick connector 69 which releasably connects the supply line 65 to the conduit 70. See FIG. 7.

Alternatively to avoid special machining a line can be run directly into the platen or tunnel with at least one exiting port or, a wand or halo type ring with at least one opening, may be further placed near the exit and connected to the line (not shown). There is also preferably a plurality of subports 49 (see e.g. FIGS. 5–6) that connect to the ports 42 for introducing inert or partially inert gas and/or bi-phasic inerting media.

Preferably at least one entry point or inlet e.g., 42A for the gas or inerting media is machined in the backer, bolster, die, pressure ring, or other suitable component of the extruder. Of course the entry or injection point may be placed or machined in other parts or components of the extruder. The port or ports are also preferably machined in at an angle, preferably of about 10 to 45 degrees. In any case, the entry point of the gas or inerting media should be near the die exit, since it is more difficult to achieve the desired environment or atmosphere if the entry points is moved away from the die exit.

Also there is preferably an analyzing means at or near the exit. The analyzing means preferably includes at least one probe or sensor 130 near the exit, which samples the nitrogen, oxygen, argon and/or other component content in the immediate environment or exit area. However, other analyzing components may be located away from the die or die exit. The sampling probe or sensor 130 is preferably run on the inside of the platen or tunnel or otherwise place near the exit. Of course an aperture for the sampling probe or sensor could also be machined into a component of the extruder. Similarly, a sample line could be placed near the die exit and the sample transferred away from the die to a sampling probe or sensor. The analyzing means may also incorporate or include a variety of other components or parts known or used by one skilled in the art, such as sample conditioning. The analyzing means further typically comprises a computer and/or other equipment or components that provide real time atmosphere analysis by continued sampling, to preferably maintain an atmosphere or environment of less than one percent oxygen.

Figure 7:
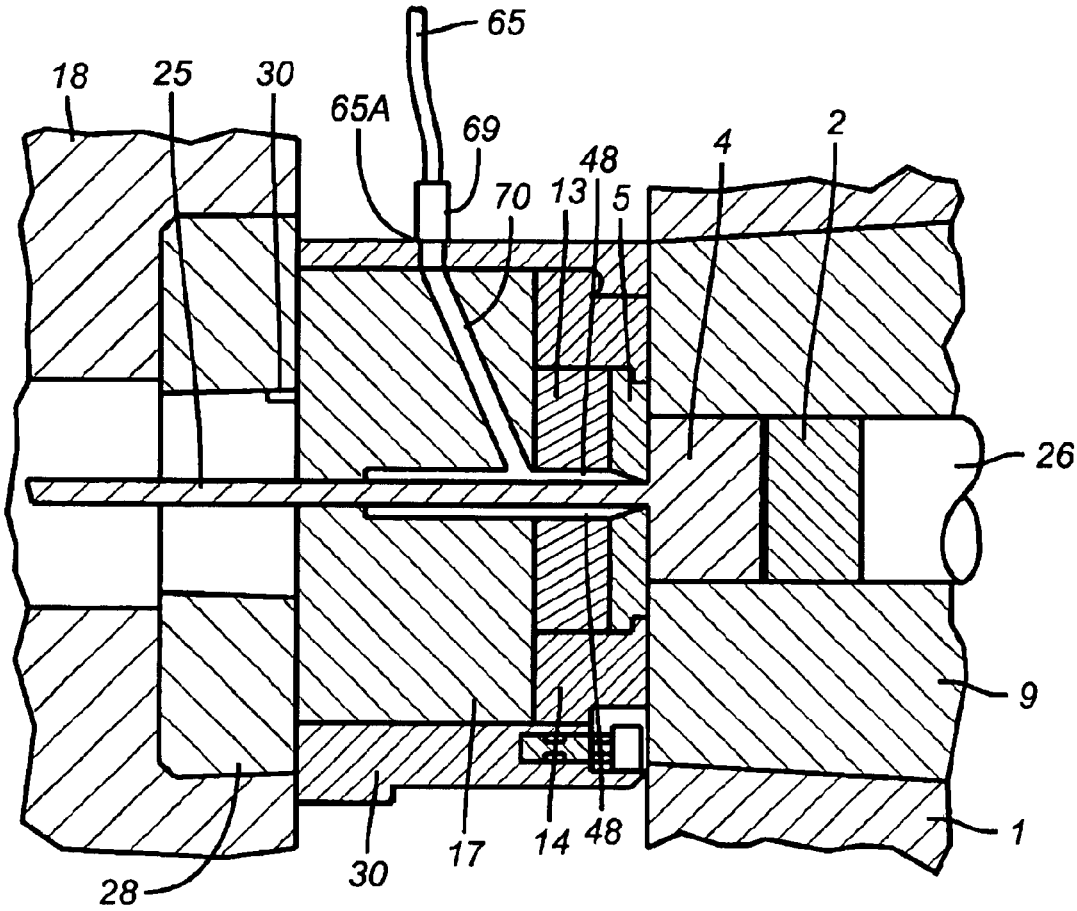
FIG. 7 is a side view of embodiment of the invention.

At least one probe 130 is placed near the die exit, e.g. FIG. 7, preferably within about 1–10 cm from the die exit and periodically or continually measures the atmosphere to ensure the oxygen level stays below at least 3%, but preferably about 1% or less. Similarly, a sample line could be placed near the die exit and the sample transferred away from the die to a sampling probe or sensor. Additionally, a plurality of probes or sensors may be used to sample and detect different values or parameters at different locations in the environment.

Preferably the process and apparatus also include the use of an analyzer which monitors, oxygen levels in the gas-supplied environment at or near the exit. A preferred analyzer is the ALNAT SAMPLER™ analyzer commercially available from Air Liquide, but a Siemens Infrared or other such comparable analyzer that is commercially available or know to one skilled in the art can be used.

The apparatus may also have a plurality of ports for introducing gas and/or bi-phasic inerting media at or near the exit or away from the exit area if a more extensive inerting media at or near the exit or away from the exit area if a more extensive inerting environment is desired or to increase the flow of gas or inerting media at or near the exit and/or platen tunnel 58.

The invention may also be further directed to the use of oxygen atmosphere sampling coupled with flow control to maintain or reduce the oxygen levels below one percent, and to optimize gas usage and effectiveness. Additionally, there is also preferably controlling means for regulating the flow rate and/or pressure of the gas and/or bi-phasic inerting media, which may be manual or automatic. The controlling means preferably comprises at least one valve or other means such as a manifold or other components which open and close and which are known to one skilled in the art that control the pressure, flow, and/or purity of the gas or inerting media. The valves or other means may also have the ability to adjustably open and close to increase the flow of gas or inerting media or to close altogether when the inerting atmosphere is not needed. The controlling means also preferably incorporates a computer that is preferably programmed for controlling the pressure, flow, and/or purity of the gas or inerting media. In the preferred embodiment, the controlling means maintains the environment in a desired range of oxygen concentration and/or nitrogen, or argon concentration, expressed in parts per million (ppm), or volume percentage or other comparable values known or used by one skilled in the art.

Optimally, the analyzing means and controlling means are coupled. The measured oxygen content may also be used by the controller or controlling means to regulate the pressure and/or flow of the gas and/or bi-phasic inerting media in a feedback loop fashion that ensures the optimized consumption of gas and/or inerting media and accommodates upsets in air flow around the extruder for purging the environment of excess oxygen. Further, the analyzer and controller may interface to maintain the environment in a desired range, and enables the apparatus to regulate the flow rate and/or pressure and/or purity of the gas or inerting media in a desired range based upon the analysis, which is preferably continuous or nearly continuous.

The apparatus also preferably has at least one component such as a computer, programmable logic device or other component known or used by one skilled in the art for recording and/or storing data about the pressure, flow, and/or purity of the gas or inerting media as well as the environment which is analyzed during the extrusion process. The data logging and reporting maybe accomplished by a Data III™, commercially available through Air Liquide, or other such commercially available component which is known to one skilled in the art.

The typically extruded materials from the apparatus and in the process comprise metal or alloys of metal, but may also include other types of materials and with other applications where materials readily oxidize during processing.

The apparatus also preferably has at least one unit for displaying or reporting data. The data may be displayed on a variety of components such as a CRT, LED screen, computer monitor, paper printout and other types of displaying means known or used by one skilled in the art. The apparatus may also have sound and/or light components and alarms to indicate when certain processes occur, when the desired environment is reached, or when there is a problem or failure with the inerting gas, media or environment.

The apparatus may also have platen or tunnel 58 with an end extending outward from the exit. The exit area and tunnel is where the oxidation typically takes place during extrusion. Due to the design of the apparatus, the tunnel does not have to be closed or under any certain pressures since it is about 2 to 3 feet long and the materials or pieces are inerted in the tunnel. In fact, the platen tunnel end may even be open since the gas flow at or near the die exit causes an exiting gas flow from the tunnel, thereby preventing atmospheric air from entering the tunnel or otherwise reaching the exit or exit area. Alternatively, the platen tunnel end may be partially closed. Also in an embodiment, there may also be a collar or rim (not shown) placed within the platen tunnel to partially contain the inerting gas.

The invention also contemplates a method of decreasing or inhibiting oxide formation on the surface of extruded metal or metal alloy which comprises the steps of extruding metals, metal alloys, or other materials through a die having an exit, inerting the surface of the metal or other material in the environment at or near the exit with inert or partially inert gas and/or bi-phasic inerting media, and analyzing the environment. The method may be used for metal or metal alloy comprising aluminum, zinc, and/or magnesium, or other materials which tend to oxidize during production. In this method, there are at least one, but may be a plurality of ports and/or subports for injecting gas and other inerting media at or near the exit.

FIG. 4 shows an embodiment of the invention showing a gas source 90 which is split into two separate lines, a first line 92 and a second line 94 and leads to a first extruder 102 and a second extruder 104. Of course additional extruders can be operated from a single or multiple gas or inerting media source. Prior to reaching the respective extruders, there is a first and second isolation valve 93, 95 respectively, for the first extruder and second extruder, respectively, as well as a first and second extruder control valve 97, and 98. The lines then lead to the extruders where they are introduced into the die exit area. In or around the die exit areas of the first extruder 102 and a second extruder 104, there is a first and second solenoid valve, one near each extruder, and a first 107 and a second 109 sample isolation valve. Each sample from each respective extruder is then analyzed by a single portable analyzer. The use of a single analyzer for multiple extruders will give analytical information, which can be used to manually or automatically control the gas or inerting media, but will not likely give real time data. Of course, a built in analyzer could also be used in other embodiments and/or a single analyzer could be used for each operating extruder to give real time data.

In this method, the oxygen content of the environment is analyzed. The nitrogen and/or argon content of the environment may also be analyzed, as well as any other inerting compounds or elements. The method may also comprise the step of controlling the flow rate and/or pressure of the gas and/or inerting media based upon the analysis of the environment. The method may also comprise the step of controlling the purity of the gas or inerting media based upon the analysis. Optimally, the analyzing means and controlling means are coupled. The loop analysis and control option uses sensors or probes to measure the oxygen content in the atmosphere at or near the exit, and then uses the results to regulate the flow, pressure, and/or purity of the gas or inerting media.

In practicing this method, the oxygen and/or nitrogen and/or argon concentration near or at the exit may be continually monitored, or periodically monitored at set, random, or predetermined intervals.

In this method due to cost, the inerting media or gas preferably comprises primarily nitrogen. During this method, the gas or inerting media may contain 0.1%–1% by volume of oxygen, but preferably contains about 2% oxygen or less, and most preferably about 1% or less during aluminum extrusion applications. Since in the preferred embodiment the platen or tunnel is open or at least partially closed, there is preferably a continuous flow of gas and/or inerting media during extrusion. However, in some application, a near continuous flow of gas during extrusion may also suffice. Preferably, the gas flow that is controlled to maintain the desired range at or near the exit. The nitrogen flow is about 500 to 2500 standard cubic feet per hour (SCFH) but preferably about 2000–2500 SCFH, depending on the size of the press with pressures at about 50–150 psi (pounds per square inch). The temperature of the gas is not critical since the gas is not used to cool but is rather used to provide an inert or nearly inert atmosphere, and the preferred temperature parameters of the inerting gas are from about 0° C. to room temperature or about 20° C. In this method, the various parameters may be controlled manually and/or automatically.

The method may also further comprise the step of placing a collar or shroud around the die exit area and at least one port may be positioned near the collar or shroud, to somewhat slow the exit of gas from the environment around the die exit area.

In this method, a platen or tunnel may be placed near or at the die exit. The platen also has an end, and the end can be open during extrusion operations, since the method can operate at ambient pressure. In another embodiment, the platen tunnel end is at least partially closed. In addition to having at least one port for introducing or adding gas or inerting media near or at the die exit, the method may further comprise adding at least one additional port and/or subport for injecting gas and/or inerting media into the platen tunnel, outward from the port used near or at the die exit. See FIGS. 5–6. Similarly, the method may also further comprise the step of placing a collar or shroud around the tunnel to somewhat slow the exit of gas from the tunnel area.

If a bi-phasic or liquid inerting media is used, it may be advantageous to place a channel around the exit so that the vaporized liquid travels around the channel and around the extruded material.

The method may further comprise the step of providing at least one component that records and/or stores data. The component can comprise a mainframe computer, hard drive, portable computer unit or other component known or used by one skilled in the art for recording and/or storing data. The data recorded or stored in this method may comprise a multitude of variables such as the pressure, flow, and/or purity of the gas or inerting media used as well as the temperature, pressure, and the purity of the inerting gas or media in the environment which is analyzed during the extrusion process. The method may also comprise tracking the volume or amount of gas or inerting media used.

The method may further comprise the step of providing at least one unit for displaying or reporting data. The unit to display such data may comprise a variety of components such as CRT, LED screen, computer monitor, paper printout and other types of displaying means known or used by one skilled in the art. The method may further comprise the step of providing sound and/or light components and alarms to indicate when certain processes occur, when the desired environment is reached, or when there is a problem or failure with the inerting gas, media or environment.

The following is an example of data that shows some of the advantages of this invention:

TABLE 1

| Product | Gas Consumption (SCFH equivalent) | Extrusion Speeds | Die Run Life | Surface Quality | Die Condition After Run |
|---|---|---|---|---|---|
| Architectural Aluminum (6063) | 500–1000 | 30% faster | +60 Billets | 50% Less Buffing | No Polishing Required |
| Structural Aluminum (6061) | 600–800 | 25% faster | +75 Billets | Bright - No Die Lines | No Polishing Required |

There are some key cost advantages of inerting the environment with the gas versus liquid based cooling. For example, the preferred embodiment comprises a delivery system which is preferably simplified in that there are few or no moving parts, and does not require recirculators for operation.

The apparatus and method are also cost efficient as no special machining of the dies or reworking of the die tooling is required. In the prior art applications, a channel must be machined into the die, and the liquid nitrogen was channeled into the backer and then the backer has another groove that feeds the gas into it. So, each die has to be machined with a channel. Now preferably, only the bolster and/or backer and/or die ring 14 requires modification. Alternatively as previously set forth, a line can be run into the platen, serving as a single port, or a wand or halo may be attached to the line, which provides multiple subports.

The prior art was also concerned with the size of the feed based on how much cooling that was needed around the die. It was assumed that anything that came out was going to inert the die exit, but what the atmosphere looked like as far as oxygen composition was ignored. The inerting was a secondary benefit, and the real focus was cooling the die. Thus, the flow rate, pressure, and/or purity of the gas or inerting media, can be monitored to maintain and/or control the desired oxygen level or ranges. The invention modifies and improves upon the prior art use of nitrogen-based die "cooling" technologies by strategically incorporating the proper gas composition and purity, phase properties, and analytical methods into the die inerting process. This invention may also in some cases lower nitrogen consumption than the previous "cooling" based methods, while greatly enhancing the inerting abilities of the gas and/or liquid.

It is to be understood that the invention may assume various alternative structures and processes and still be within the scope and meaning of this disclosure. Further, it is to be understood that any specific dimensions and/or physical characteristics related to the embodiments disclosed herein are capable of modification and alteration while still remaining within the scope of the present invention and are, therefore, not intended to be limiting. It will be understood that many additional changes in the details, materials, steps and arrangement of parts, which have been herein described and illustrated in order to explain the nature of the invention, may be made by those skilled in the art within the principle and scope of the invention as expressed in the appended claims. Thus, the present invention is not intended to be limited to the specific embodiments in the examples given above and/or the attached drawings.

What is claimed is:

1. An improved extrusion apparatus comprising:

an extruder comprising a die having an exit, wherein said extruder is capable of extruding materials;

a supply of inert or partially inert gas and/or biphasic inerting media that contains about 3% or less oxygen;

means for introducing inert or partially inert gas and/or biphasic-inerting media near or at said die exit during extrusion;

at least one sensor near said die exit to detect oxygen in an environment near the die exit;

analyzing means to analyze the amount of oxygen in said environment;

controlling means for regulating flow rates of said gas and/or biphasic inerting media; and wherein the flow rates of said gas introduced at or near said die exit is controlled to be within a range between about 500 to about 2500 standard cubic feet per hour.

2. The apparatus of claim 1, wherein said analyzing means and controlling means are coupled and interface to maintain said environment in a desired range of about 3% or less oxygen based upon said oxygen analysis.

3. The apparatus of claim 1, wherein said controlling means comprises at least one valve.

4. The apparatus of claim 3, wherein said controlling means further comprises a computer.

5. The apparatus of claim 4, wherein said analyzing means further comprises a computer and/or other equipment that provides real time analysis by continued sampling.

6. The apparatus of claim 4, which allows for automated or manual control of an environment at or near said exit.

7. The apparatus of claim 1, wherein said controlling means maintains said environment in a desired range of about 0% oxygen to about 3% oxygen.

8. The apparatus of claim 1, having a platen tunnel with an end extending outward from said die exit that is least partially open.

9. The apparatus of claim 1, having at least one port that leads to a header placed around an opening on a bolster and/or to a header placed around an opening on a backer.

10. The apparatus of claim 9, having at least one subport that directs said gas and/or biphasic inerting media from the header into the opening in the bolster and/or to the header around the opening in the backer.

11. The apparatus of claim 9, having at least one subport that directs said gas and/or bi-phasic inerting media from a header on a die into an opening in the die and/or to a header on a die slide into an opening on a die slide.

12. The apparatus of claim 1, wherein the controlling means also controls the pressures of said gas and/or inciting media between about 50 psi to about 150 psi.

13. The apparatus of claim 12, wherein the measured oxygen content determines the pressures and/or flow rates of said gas introduced at or near the die exit.

14. The apparatus of claim 1, wherein the introduction of gas and/or the biphasic inciting media near or at said die exit during extrusion inhibits or decreases the formation of oxides on extruded materials and the die.

15. The apparatus of claim 14, wherein the life of the die is increased about two fold due to the decreased oxide formation.

16. The apparatus of claim 14, wherein extrusion speeds can be increased up to about 25% to about 30% for aluminum.

17. The apparatus of claim 1, further comprising at least one component for recording and/or storing data.

18. The apparatus of claim 1, further comprising at least one unit for displaying or reporting data.

19. An apparatus for decreasing or inhibiting oxide formation during the extrusion of metal, comprising:

an extrusion press comprising a die having an exit, wherein said extrusion press is capable of extruding materials;

a platen tunnel with an end extending outward from said die exit that is at least partially open;

an environment near or at said die exit;

a supply of gas comprising up to about 3% oxygen and an inert or partially inert gas selected from the group consisting essentially of nitrogen, argon, helium, or a combination thereof;

at least one port that directs said gas into said environment;

at least one probe for sampling oxygen within said environment;

an analyzer to measure amounts of said sampled oxygen in said environment;

a controller for regulating flow rates and/or pressures of said gas; and wherein the introduction of said gas near or at said die exit during extrusion inhibits or decreases the formation of oxides on extruded materials and the die.

20. The apparatus of claim 19, further comprising at least one valve which controls said gas from or to said at least one port.

21. The apparatus of claim 19, wherein said analyzer and said controller interface to maintain said environment in a desired range of about 3% or less oxygen based upon said measured oxygen.

22. The apparatus of claim 21, having an analyzer that analyzes samples from at least one environment of at least one die which allows for automated or manual control of said at least one environment at or near said exit.

23. The apparatus of claim 19, wherein said controller also regulates gas purity.

24. The apparatus of claim 19, wherein said at least one port leads to a header on a backer and/or a header on a bolster.

25. The apparatus of claim 24, having a plurality of subports that lead from said header to an opening in said bolster or to and opening in said backer.

26. The apparatus of claim 24, having a header with plurality of subports on at least some of the components of the extruder, wherein said components are selected from the group consisting essentially of a bolster, a backer, a die, a die ring, or a combination thereof.

27. The apparatus of claim 26, wherein said subports on said selected components lead to an opening in said components through which materials are extruded.

28. The apparatus of claim 19, wherein the flow rates of said gas is controlled to be within a range between about 500 to about 2500 standard cubic feet per hour and wherein the pressures of said gas is controlled to be within a range between about 50 psi to about 150 psi.

29. The apparatus of claim 19, having a channel or ring around the die exit and a plurality of ports therein through which said gas and/or biphasic inerting media enters said environment.

30. A method of inhibiting oxide formation during the extrusion of metal or metal alloys comprising the steps of:

extruding metals or metal alloys through an extruder comprised of a die having an exit;

providing a flow of inert or partially inert gas and less than about 3% oxygen during extrusion into an environment at or near said die exit monitoring and analyzing the environment during extrusion to determine amounts of oxygen in said environment; and controlling gas flow rates to ensure that the environment is comprised of less than about 3% oxygen in order to inhibit oxide formation during extrusion.

31. The method of claim 30, further comprising the step of controlling gas pressures based upon the amounts of oxygen in said environment.

32. The method of claim 30, wherein said gas comprises primarily nitrogen.

33. The method of claim 32, wherein said gas contains about 0.1% to about 2% by volume or less of oxygen.

34. The method of claim 30, further comprising the step of controlling the purity of said gas to ensure that the environment is comprised of less than about 3% oxygen.

35. The method of claim 30, further comprising the step of providing a plurality of ports and/or subports for injecting said inerting gas at or near said exit.

36. The method of claim 30, further comprising the step of placing a platen tunnel with an end near or at said exit and leaving said end at least partially open.

37. The method of claim 30, further comprising the steps of:

providing a junction that leads from a port to a header on at least some of the components through which metal is extruded; and providing a plurality of subports that lead from said header to an opening in said components, wherein said components are selected from the group consisting essentially of a bolster, a backer, a die, a die ring, or a combination thereof.

38. The method of claim 30, wherein said extruded metal or metal alloy comprises metal selected from the group consisting essentially of aluminum, zinc, magnesium, or a combination thereof.

39. The method of claim 30, further comprising the step of placing a collar around said exit to partially contain the gas and wherein said at least one port is positioned near said collar.

40. The method of claim 30, further comprising the step of placing a channel or halo having a plurality of ports therein around said exit for introducing said gas into said environment.

41. The method of claim 30, wherein the flow rates of said gas and/or inerting media is controlled to be within a range between about 500 to about 2500 standard cubic feet per hour.

42. The method of claim 30, wherein the pressures of said gas is controlled to be within a range between about 50 psi to about 150 psi.

43. The method of claim 34, wherein the temperature of said gas is controlled to be within a range between about 0° C. to about 20° C.

44. An improved method of of extruding metals, comprising:

extruding metal through an apparatus having components through which metal is extruded and an exit area for said extruded metal;

introducing inert or partially inert gas at or near said exit area wherein said gas comprises about 3% or less oxygen at flow rates within a range between about 500 to about 2500 standard cubic feet per hour;

monitoring and analyzing the oxygen concentration at or near said exit area; and controlling the flow rates of said gas based upon results of said analysis.

45. The method of claim 44, operated at ambient pressure.

46. The method of claim 44, wherein said oxygen concentration near or at said exit area is continually or periodically monitored.

47. The method of claim 44, having a continuous flow of gas during extrusion.

48. The method of claim 44, having a near continuous flow of gas during extrusion.

49. The method of claim 44, having a gas flow that is controlled to maintain a desired oxygen concentration range at or near said exit area that is less than about 3% oxygen.

50. The method of claim 44, wherein said gas comprises primarily nitrogen.

51. The method of claim 50, wherein said gas contains about 1%–2% oxygen by volume or less.

52. The method of claim 50, further comprising the step of using a portable or permanent analyzer that analyzes samples from at least one die and which allows for automated or manual control of an environment at or near said exit area.

53. The method of claim 52, wherein said apparatus has multiple dies that are operated simultaneously.

54. The method of claim 50, further comprising the step of connecting a platen tunnel with an end near said exit area.

55. The method of claim 54, wherein said platen tunnel end is at least partially closed.

56. The method of claim 54, having at least one port for introducing gas into the platen tunnel near said exit area.

57. The method of claim 54, having at least one port for injecting gas and/or liquid into said platen tunnel.

58. The method of claim 56, further comprising the steps of:

providing a junction that leads from said port to a header, wherein said header is placed around an opening in at least one of said components through which the metal is extruded; and providing a plurality of subports that lead from said header to an opening in said components through which metal is extruded, wherein said components are selected from the group consisting essentially of a bolster; a backer; a die; a die ring; or a combination of thereof.

59. The method of claim 58, further comprising the steps of:

providing a conduit in the die slide;

connecting a supply of gas or to said conduit; and connecting said conduit to said header.

60. The method of claim 44, further comprising the step of placing a collar around said exit area.

61. The method of claim 60, further comprising the step of placing at least one-port in or near said collar and introducing gas through said port.

62. The method of claim 44, further comprising the step of recording and/or storing data from the results of said analysis.

63. The method of claim 44, further comprising the step of providing at least one unit for displaying or reporting data from the results of said analysis.

64. The method of claim 44, further comprising the step of providing equipment that provides real time atmospheric or environmental analysis by continued sampling.

* * * * *

UNITED STATES PATENT AND TRADEMARK OFFICE

CERTIFICATE OF CORRECTION

PATENT NO. : 6,898,954 B2 
DATED : November 27, 2002
INVENTOR(S) : Richard Twigg and Robert Oesterreich It is certified that error appears in the above-identified patent and that said Letters Patent is hereby corrected as shown below:

Column 11,
Lines 23 and 28, replace the word "inciting" with the word -- inerting --.

Column 13,
Line 25, replace the number "34" with the word -- 30 --.

Signed and Sealed this

Twenty-third Day of August, 2005

JON W. DUDAS
*Director of the United States Patent and Trademark Office*